US009390609B2

(12) United States Patent
Hogg et al.

(10) Patent No.: US 9,390,609 B2
(45) Date of Patent: Jul. 12, 2016

(54) MONITORING APPARATUS

(71) Applicant: Draeger Safety UK Limited, Blyth, Northumberland (GB)

(72) Inventors: Simon Hogg, Whitley Bay (GB); Norman Webster, Cramlington (GB)

(73) Assignee: Draeger Safety UK Limited, Blyth (GB)

( * ) Notice: Subject to any disclaimer, the term of this patent is extended or adjusted under 35 U.S.C. 154(b) by 29 days.

(21) Appl. No.: 13/672,176

(22) Filed: Nov. 8, 2012

(65) Prior Publication Data

US 2013/0113620 A1 May 9, 2013

(51) Int. Cl.

| | |
|---|---|
| ***G08B 1/08*** | (2006.01) |
| ***G08B 21/04*** | (2006.01) |
| ***A62B 9/00*** | (2006.01) |

(52) U.S. Cl.

CPC ..... *G08B 21/0453* (2013.01); *A62B 9/006* (2013.01)

(58) Field of Classification Search

CPC ..... G06F 19/3418; A62B 9/006
USPC ..... 340/539.12, 573.1
See application file for complete search history.

(56) References Cited

U.S. PATENT DOCUMENTS

| | | | | |
|---|---|---|---|---|
| 5,438,320 A | | 8/1995 | Taylor | |
| 5,781,118 A | | 7/1998 | Wise et al. | |
| 5,910,771 A | * | 6/1999 | Stumberg | A62B 9/006 2/69 |
| 6,472,988 B1 | * | 10/2002 | Feld | A62B 9/006 340/539.1 |
| 6,626,045 B2 | * | 9/2003 | Krumpolz | G01L 9/14 73/722 |
| 7,089,930 B2 | * | 8/2006 | Adams | A62B 9/006 128/201.27 |
| 2004/0046710 A1 | * | 3/2004 | Adams | A62B 9/006 345/8 |
| 2007/0229356 A1 | * | 10/2007 | Kodrin | G01S 1/047 342/458 |
| 2008/0284589 A1 | * | 11/2008 | Parkulo | G08B 25/016 340/539.13 |

FOREIGN PATENT DOCUMENTS

| | | |
|---|---|---|
| EP | 1148326 | 7/2011 |
| GB | 923 812 | 4/1963 |
| WO | 97/30756 | 8/1997 |

OTHER PUBLICATIONS

Search Report from corresponding European Application No. 12191375.0 dated May 21, 2015.

* cited by examiner

*Primary Examiner* — Hai Phan
*Assistant Examiner* — Zhen Y Wu
(74) *Attorney, Agent, or Firm* — DLA Piper LLP (US)

(57) ABSTRACT

There is provided an apparatus for monitoring a wearer of a breathing apparatus, comprising a pressure detecting device and a mobile monitoring unit. The pressure detecting device comprises a pressure transducer arranged to detect a pressure of a gas supply of the breathing apparatus; and a wireless transmitter arranged to wirelessly transmit a preset number of ON signals when it is determined that the pressure of the gas supply has exceeded a predetermined on threshold. The mobile monitoring unit is arranged to be attached to the wearer and comprises a motion sensor arranged to monitor the motion of the wearer; an alarm; and a wireless receiver arranged to receive signals wirelessly transmitted by the wireless transmitter of the pressure detecting device.

12 Claims, 2 Drawing Sheets

MONITORING APPARATUS

CROSS REFERENCE TO RELATED APPLICATIONS

This application claims the priority of UK Patent Application No. 1119347.1, filed on 9 Nov. 2011, the entire contents of which are incorporated herein by reference.

BACKGROUND OF THE INVENTION

The invention relates to an apparatus for monitoring a wearer of a breathing apparatus.

Breathing apparatus, such as self-contained breathing apparatus (SCBA), is frequently used by persons working in hazardous environments. Breathing apparatus typically comprises a cylinder of breathable gas mounted on a harness carried by the user, and a delivery device, such as a mask, that supplies the breathable gas to the user. A pressure gauge, such as a manual gauge or a digital gauge, is usually provided so that the wearer can monitor the amount of breathable gas remaining in the cylinder.

A mobile monitoring unit such as a PASS (Personal Alert Safety System) or ADSU (Automatic Distress Signal Unit) is often used with breathing apparatus and in some cases is required by law. A PASS/ADSU comprises a motion sensor that monitors the motion of the wearer and an alarm, for example an audible or visual alarm, that is activated if motion is not detected for a pre-determined period of time. If no motion is detected it may indicate that the wearer is injured or incapacitated and therefore the alarm may alert rescue personnel to the location of the wearer.

It is important that the mobile monitoring unit is turned on before the wearer enters the hazardous environment. This is typically done by pressing a combination of manual buttons. However, it is possible that under pressure the wearer may forget to turn on, the monitoring unit. This is undesirable.

There have been previous attempts to solve this problem. In one previously considered arrangement the mobile monitoring unit includes a pressure sensor that is connected to the breathable gas supply. When the breathable gas supply is turned on the mobile monitoring unit is also turned on. Whilst this may be satisfactory, it is often not desirable or convenient to locate the pressure sensor within the mobile monitoring unit. The use of a cable to connect a pressure sensor to a mobile monitoring unit is possible but it may provide a snag risk.

It is therefore desirable to provide an improved apparatus for monitoring a wearer of breathing apparatus.

SUMMARY OF THE INVENTION

An exemplary embodiment of the present invention comprises an apparatus for monitoring a wearer of a breathing apparatus, comprising a pressure detecting device including a pressure transducer arranged to detect a pressure of a gas supply of the breathing apparatus and a wireless transmitter arranged to wirelessly transmit a preset number of ON signals when it is determined that the pressure of the gas supply has exceeded a predetermined on threshold, and a mobile monitoring unit arranged to be attached to the wearer including a motion sensor arranged to monitor the motion of the wearer, an alarm, and a wireless receiver arranged to receive signals wirelessly transmitted by the wireless transmitter of the pressure detecting device, wherein the mobile monitoring unit has a plurality of operational states including an ON state in which the alarm is activated when the motion sensor has not detected motion for a predetermined period of time, and an OFF state, and wherein the mobile monitoring unit is arranged to be switched from the OFF state to the ON state when the wireless receiver receives at least one ON signal from the wireless transmitter.

Another exemplary embodiment of the present invention comprises an apparatus for monitoring a wearer of breathing apparatus, comprising a pressure detecting device including a pressure transducer arranged to detect a pressure of a gas supply of the breathing apparatus and a wireless transmitter arranged to wirelessly transmit a preset number of discrete and spaced apart ON signals when it is determined that the pressure of the gas supply has exceeded a predetermined on threshold, and a mobile monitoring unit arranged to be attached to the wearer including a motion sensor arranged to monitor the motion of the wearer, an alarm, and a wireless receiver arranged to receive signals wirelessly transmitted by the wireless transmitter of the pressure detecting device, wherein the mobile monitoring unit has a plurality of operational states including an ON state in which the alarm is activated when the motion sensor has not detected motion for a predetermined period of time, and an OFF state, wherein the mobile monitoring unit is arranged to be switched from the OFF state to the ON state when the wireless receiver receives at least one ON signal from the wireless transmitter, and wherein the wireless receiver periodically listens for a signal transmitted by the wireless transmitter, wherein the time period between periodic listening times of the wireless receiver and the time period between signals transmitted from the transmitter are configured such that in use the wireless receiver receives at least one signal transmitted from the wireless transmitter, and wherein the pressure detecting device is arranged for uni-directional wireless communication with the mobile monitoring unit.

Another exemplary embodiment of the present invention comprises a breathing apparatus for use by a wearer in hazardous environments, comprising a supply of breathable gas, a pressure detecting device including a pressure transducer arranged to detect a pressure of the gas supply and a wireless transmitter, wherein the wireless transmitter is arranged to wirelessly transmit a preset number of ON signals when it is determined that the pressure of the gas supply has exceeded a predetermined on threshold, wherein the wireless transmitter is arranged to wirelessly transmit a preset number of OFF signals if it is determined that the pressure of the gas supply has fallen below a predetermined off threshold, and a mobile monitoring unit including a motion sensor, an alarm, and a wireless receiver arranged to receive signals wirelessly transmitted by the wireless transmitter of the pressure detecting device, wherein the mobile monitoring unit has a plurality of operational states including an ON state in which the alarm is activated when the motion sensor has not detected motion for a predetermined period of time and an OFF state, wherein the mobile monitoring unit is arranged to be switched from the OFF state to the ON state when the wireless receiver receives at least one ON signal from the wireless transmitter; and wherein when the wireless receiver has received at least one OFF signal, the mobile monitoring unit can be manually switched from the ON state to the OFF state.

BRIEF DESCRIPTION OF THE DRAWINGS

Embodiments of the invention will now be described, by way of example, with reference to the accompanying drawings, in which.

DETAILED DESCRIPTION

Figure 1:
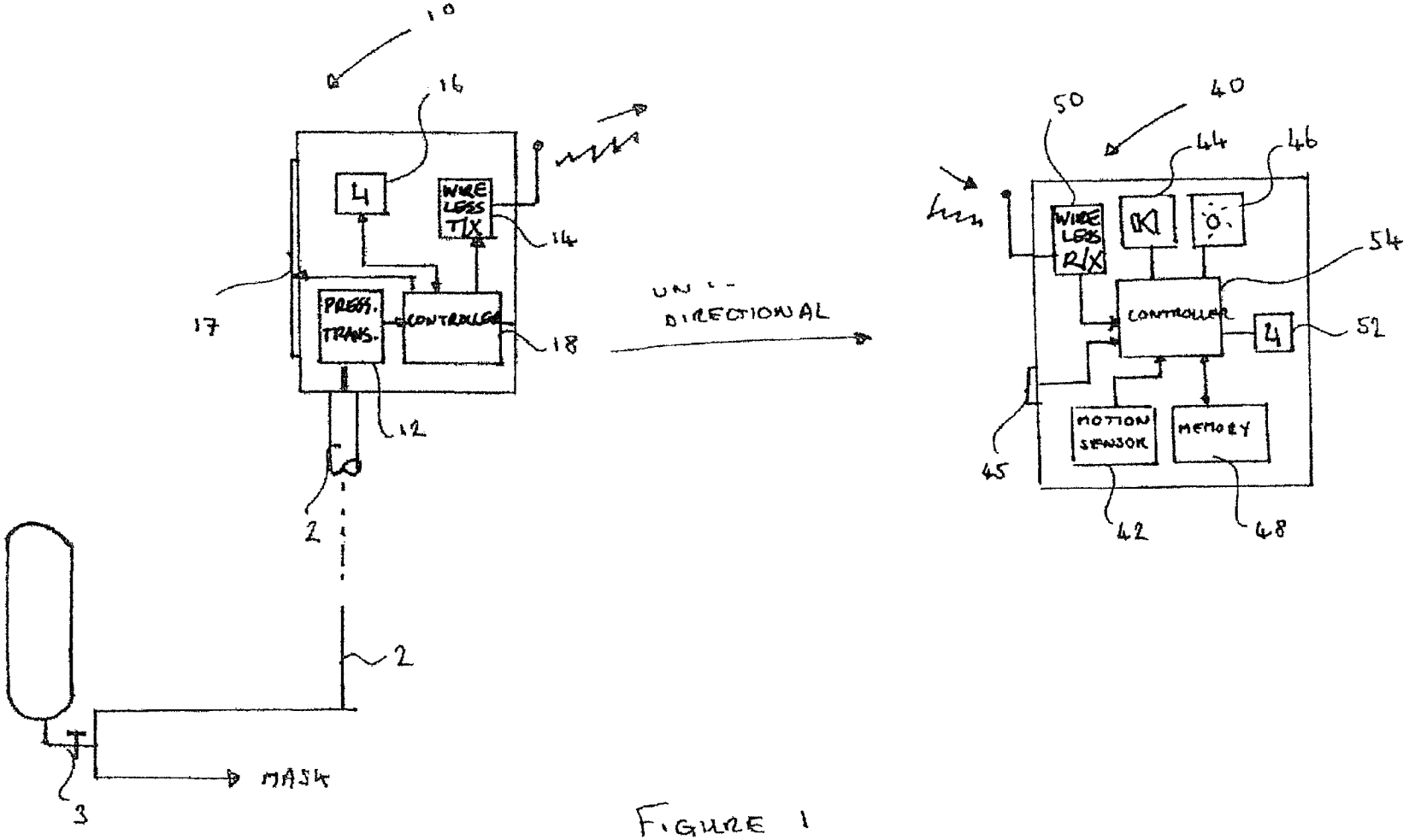
FIG. 1 schematically shows an exemplary embodiment of an apparatus for monitoring a wearer of breathing apparatus comprising a pressure detecting device and a mobile monitoring unit.

In a broad aspect the invention relates to an apparatus for monitoring a wearer of breathing apparatus comprising a pressure detecting device and a mobile monitoring unit, such as a PASS or ADSU. The pressure detecting device is arranged for wireless communication with the mobile monitoring unit and this wireless link may be a uni-directional link from the pressure detecting device to the mobile monitoring unit. The pressure detecting device is arranged to detect the pressure of a supply of breathable gas and is arranged to wirelessly transmit a fixed, limited or pre-determined number of on signals to the mobile monitoring unit when it detects pressure over a preset threshold. In response to receiving at least one of the on signals, the mobile monitoring unit is turned on so as to monitor at least the movement of the wearer. This arrangement ensures that when the cylinder of breathable gas is turned on, such that the pressure rises above a threshold, the mobile monitoring unit is automatically turned on. This ensures that the wearer does not forget to turn on the mobile monitoring unit.

According to an aspect of the invention there is provided an apparatus for monitoring a wearer of breathing apparatus, comprising: a pressure detecting device comprising: a pressure transducer arranged to detect a pressure of a gas supply of the breathing apparatus; and a wireless transmitter arranged to wirelessly transmit a preset number of ON signals when it is determined that the pressure of the gas supply has exceeded a predetermined on threshold; and a mobile monitoring unit arranged to be attached to the wearer comprising: a motion sensor arranged to monitor the motion of the wearer; an alarm; and a wireless receiver arranged to receive signals wirelessly transmitted by the wireless transmitter of the pressure detecting device; wherein the mobile monitoring unit has a plurality of operational states including: an ON state in which the alarm is activated when the motion sensor has not detected motion for a predetermined period of time; and an OFF state; and wherein the mobile monitoring unit is arranged to be switched from the OFF state to the ON state when the wireless receiver receives at least one ON signal from the wireless transmitter.

The pressure transducer may be arranged to convert pressure into mechanical movement or into a digital or analogue electrical signal representative of pressure. If the pressure transducer converts pressure into mechanical movement, there may be a converter that converts the mechanical movement into an electrical signal representative of pressure. The pressure transducer may be arranged to detect pressure downstream of the main valve of a cylinder of breathable gas. The pressure detecting device may comprise a processor or controller that is arranged to receive the electrical signal representative of pressure and determine whether this signal represents a pressure greater than the predetermined on threshold. The preset number of ON signals may be a fixed or limited number of ON signals. If only a fixed number of ON signals are transmitted, the power consumption of the pressure detecting device may be minimised. The time period between each ON signal may be configured such that it can be guaranteed that at least one ON signal will be received by the mobile monitoring unit. This may mean that the mobile monitoring unit does not have to send an acknowledgement signal and therefore does not need to be provided with a wireless transmitter.

The mobile monitoring unit may comprise a PASS (Personal Alert Safety System) and/or an ADSU (Automatic Distress Signal Unit) and may comply with the requirements of JCDD/38 and/or BS10999 and/or NFPA 1982. The mobile monitoring unit may enter a pre-alarm mode, which may comprise visual and/or audible signals, if motion is not detected for a certain period of time. It may be possible to cancel this pre-alarm mode manually by movement or by pressing a manual button on the mobile monitoring unit. If the pre-alarm mode is not cancelled, and motion is not detected for a further period of time, the mobile monitoring unit may enter a full-alarm mode, which may comprise visual and/or audible signals. The mobile monitoring unit may be provided with attachment means, such as clips or straps, for attaching the unit to a wearer of breathing apparatus or to breathing apparatus. The wireless receiver of the mobile monitoring unit may periodically listen (e.g., scan) for signals. The time period between listening times may be configured, in conjunction with the time period between transmitted signals and the number of transmitted signals, such that it can be virtually guaranteed that the mobile monitoring unit will receive a transmitted signal. This means that it may not be necessary to transmit an acknowledgement signal. If the mobile monitoring unit does not continually listen for signals, the power consumption may be reduced. The mobile monitoring unit may listen for wirelessly transmitted signals in both the ON state and the OFF state. In the OFF state, the mobile monitoring unit may not monitor the motion of the wearer and may be essentially dormant.

The wireless transmitter may transmit less than 10, less than 8, less than 6 or less than 4 ON signals when it is determined that the pressure of the gas supply has exceeded a predetermined on threshold. The predetermined on threshold may be at least 6 bar, at least 8 bar, or at least 10 bar. The signals may be addressed to a specific mobile monitoring unit.

The wireless transmitter may be arranged to wirelessly transmit a preset number of OFF signals if it is determined that the pressure of the gas supply has fallen below a predetermined off threshold. The wireless transmitter may transmit less than 10, less than 8, less than 6 or less than 4 OFF signals when it is determined that the pressure of the gas supply has fallen below a predetermined off threshold. The predetermined off threshold may be at least 6 bar, at least 8 bar or at least 10 bar. In one arrangement, when the wireless receiver has received at least one OFF signal, the mobile monitoring unit can be manually switched from the ON state to the OFF state. The mobile monitoring unit may be provided with an off button which can be used to manually switch the mobile monitoring unit from the ON state to the OFF state. It may only be possible to manually turn the monitoring unit from the ON state to the OFF state when at least one OFF signal has been received.

The pressure detecting device may be arranged for uni-directional wireless communication with the mobile monitoring unit. The wireless receiver may periodically listen for a signal transmitted by a wireless transmitter.

The pressure detecting device may comprise a manual pressure gauge including the pressure transducer and a pointer rotatably moveable in response to the pressure detected by the pressure transducer so as to display the pressure detected, and a pointer detector for detecting the angular position of the pointer. The pointer detector may be a Hall effect sensor. An example of such a manual pressure gauge is disclosed in EP1148326. The wireless transmitter may wirelessly transmit a preset number of ON signals when the pointer detector detects that the angular position of the pointer has exceeded a predetermined angular threshold.

The wireless transmitter may wirelessly transmit a preset number of OFF signals when the pointer detector detects that the angular position of the pointer has fallen below a predetermined angular threshold.

The invention also relates to breathing apparatus comprising the apparatus in accordance with any statement herein.

The invention may comprise any combination of the features and/or limitations referred to herein, except combinations of such features as are mutually exclusive.

With reference to FIG. 1, there is provided apparatus for monitoring a wearer of breathing apparatus 1 comprising a pressure detecting device 10 and a mobile monitoring unit 40. The pressure detecting device 10 and the mobile monitoring unit 40 are discrete devices that in this embodiment are battery powered. The pressure detecting device 10 is arranged to transmit wireless signals to the mobile monitoring unit 40 by means of a uni-directional wireless link.

The pressure detecting device 10 comprises a pressure transducer 12, a wireless transmitter 14, a short-range configuration transceiver 16 and a display 17 which are all connected to a controller 18. The mobile monitoring unit 40 comprises a motion sensor 42, a sounder 44, a push button 45, a set of LEDs 46, a memory 48, a wireless receiver 50 and a short-range configuration transceiver 52 which are all connected to a controller 54. The mobile monitoring unit 40 provides the functions of a PASS (Personal Alert Safety System) or ADSU (Automatic Distress Signal Unit) and may comply with the requirements of JCDD/38 and/or BS10999 and/or NFPA 1982.

The mobile monitoring unit 40 is arranged to monitor the motion of a wearer, such as a fire-fighter, of breathing apparatus (not shown). Accordingly, the mobile monitoring unit 40 is provided with attachment means (not shown) for attaching the mobile unit 40 to either the wearer, or the breathing apparatus itself. The attachment means may be a clip, for example.

The mobile unit 40 has at least two operational states which will be referred to hereinafter as an ON state and an OFF state. The mobile unit 40 may be switched between the two states by a combination of manual button presses, or as will be described in detail below, wireless communication with the pressure detecting device 10. In the ON state the mobile unit 40 is fully operational and the motion sensor 42, in combination with the controller 54, monitors the movement of the wearer. If the motion sensor 42 has not detected motion for a pre-determined period of time, for example 20-30 seconds, the mobile unit 40 moves to a pre-alarm mode in which the sounder 44 and LEDs 46 are activated. The lack of detection of movement may indicate that the wearer is in distress. The pre-alarm mode can be cancelled by pressing a combination of buttons 45. If the pre-alarm mode is not cancelled within a pre-determined period of time, for example 5-10 seconds, the mobile unit 40 moves to a full-alarm mode in which the sounder 44 and LEDs 46 are activated at a higher level. The sounder 44 and LEDs 46 may attract rescue personnel to the wearer who may be in distress. The memory 48 records any events (ie. pre-alarm and full-alarm) and this data can be downloaded and analysed as necessary.

It is clearly important for the wearer that the mobile monitoring unit 40 is in the ON state when the wearer enters a hazardous environment. Therefore, in this embodiment the mobile monitoring unit 40 is automatically turned to the ON state when the breathing apparatus is being used. This will be described in detail below.

The pressure detecting device 10 is arranged to be connected to a hydraulic line 2 that is in fluid communication with the cylinder of breathable gas of the breathing apparatus. In this embodiment, the pressure transducer 12 of the pressure detecting device 10 is connected downstream of the main cylinder valve 3 so that it only detects gas pressure when the cylinder valve is open. The pressure transducer 12 is an electrical pressure transducer which converts the pressure detected into an electrical signal that is representative of the pressure. This electrical signal is fed to the controller 18 which converts the electrical signal into the actual pressure detected. In this particular embodiment the pressure detecting device 10 also provides the functionality of a visual pressure gauge and therefore the pressure calculated by the controller 18 is output on the display 17.

Importantly, in this embodiment, the pressure detecting device 10 is configured to wirelessly transmit a signal to the mobile monitoring unit 10 which turns it from the OFF state to the ON state when the pressure detected is above a threshold which in this embodiment is approximately 8 bar. This ensures that when the cylinder valve 3 is opened and the breathing equipment is being used, the mobile monitoring unit 40 is in the ON state in which it monitors the motion of the wearer. When the pressure detected falls below a threshold, which in this embodiment is 8 bar, the pressure detecting device 10 wirelessly transmits a signal to the mobile monitoring unit 40 which allows it to be turned off manually using the button 45. This ensures that the mobile monitoring unit 40 cannot be switched to the OFF state until the signal has been received, but prevents the mobile unit 40 from being automatically switched to the OFF state if the pressure detected falls below the threshold (for example, if the cylinder becomes empty). The operational details will be described below.

Upon initial set-up, the mobile monitoring unit 40 is programmed so that it only recognises and responds to wireless signals transmitted by the pressure detecting device 10 with which it is to be used. This is done by pairing the mobile monitoring unit 40 with an appropriate pressure detecting device 10. Both the mobile monitoring unit 40 and the pressure detecting device 10 are put into a "pairing mode" by a specific combination of button presses. The two devices are then put in close proximity to one another, preferably touching, and a series of wireless pairing signals are exchanged by the short-range configuration transceivers 16, 52 which in this embodiment transmit at a frequency of 127 kHz and have a range of less than 10 cm. During the pairing operation, the pressure detecting device 10 transmits its unique ID number to the mobile monitoring unit 40 which is stored within the controller 52. After pairing, the mobile monitoring unit 40 will only respond to signals transmitted by the particular pressure detecting device 10. If necessary, the mobile monitoring unit 40 can be re-programmed to work with a different pressure detecting device 10.

When the breathing apparatus is not in use, the pressure detecting device 10 is idle and is in a low-power mode and the mobile monitoring unit 40 is in the OFF state which is also a low-power mode in which it does not monitor movement. However, in the OFF state the wireless receiver 50 of the mobile monitoring unit 40 periodically, for example every 1 second, listens for a wireless signal. When use of the breathing apparatus is commenced, the cylinder valve 3 is opened and the gas pressure within the line 2 increases. The pressure in the line is continually detected by the pressure transducer 12 in conjunction with the controller 18. When the controller 18 detects that the pressure in the line 2 has exceeded an on threshold, which in this embodiment is 8 bar, it causes the wireless transmitter 14 to transmit a fixed and finite number of ON pulses (or signals) using a carrier signal. In this embodiment the wireless transmitter 14 transmits 4 ON signals spaced by 300 ms using a carrier signal of 40 kHz. The range of the wireless signal transmitted may be between 1-2 m which will ensure that the signal can be received by the mobile monitoring unit 40 worn by the wearer but will not be received by a large number of mobile monitoring units worn by other personnel. Included in the signal is the specific unique ID number of the pressure detecting device 10.

When the wireless receiver 50 of the mobile monitoring unit 40 next listens for a signal, it detects the 40 kHz carrier signal and starts to continually receive data. When it receives one of the ON pulses (or signals), the controller 54 checks whether the unique ID matches the ID that it is programmed to respond to. If the ID contained within the ON pulse (or signal) matches then the mobile monitoring unit 40 is switched from the OFF state to the ON state in which the mobile monitoring unit 40 monitors the movement of the wearer. The number of ON pulses (or signals), the length between pulses (or signals) and time period between the mobile monitoring unit 40 listening for signals are chosen such that it can be virtually guaranteed that if the mobile monitoring unit 40 is within range it will receive at least one of the ON pulses (or signals) and will therefore be turned on. This means that it is not necessary for the mobile monitoring unit 40 to transmit an acknowledgement signal when it has received a signal, and neither is it necessary to continually transmit ON pulses (or signals). This minimises the power consumption and component count of both the pressure detecting device 10 and the mobile monitoring unit 40.

When the pressure detected by the pressure transducer 12 falls below an OFF threshold, which in this embodiment is 8 bar, which may be the result of the cylinder valve being turned off, the wireless transmitter 14 transmits a fixed and finite number of OFF pulses (or signals). In this embodiment the wireless transmitter 14 transmits 4 OFF signals spaced by 300 ms using a carrier signal of 40 kHz. When the wireless receiver 50 of the mobile monitoring unit 40 next listens for a signal, it detects the 40 kHz carrier signal and starts to continually receive data. When it receives one of the OFF pulses (or signals), the controller 54 checks whether the unique ID matches the ID that it is programmed to respond to. If there is a match then a flag is set in the controller 54 of the mobile monitoring unit 40 which allows it to be manually turned off. Once this flag has been set, it is possible for the mobile monitoring unit 40 to be manually switched from the ON state to the OFF state using the push button 45. This prevents the mobile monitoring unit 40 from being turned off accidentally, either by the wearer or if the gas cylinder runs out.

It will be appreciated that in other embodiments, when the ON pulse (or signal) switches the mobile monitoring unit 40 from the OFF state to the ON state, a flag may be set in the controller 54 which prevents the mobile monitoring unit from being turned off. When the OFF pulse (or signal) is received by the wireless receiver 50 and verified by the controller 54 as valid, the flag may be removed such that the mobile monitoring unit 40 can be manually turned off.

Since the pressure detecting device 10 does not have to receive any wireless signals the power consumption is minimised. Further, it is not necessary for the mobile monitoring unit 40 to wirelessly transmit signals and therefore its power consumption is also minimised. The mobile monitoring unit 40 only periodically listens for wireless signals at a low-power mode. Similarly, the pressure detecting device only periodically transmits signals for a short period of time, when the on threshold and off threshold levels are crossed, the power is reduced. In addition to this, there is no actual transmission of pressure data.

Figure 2:
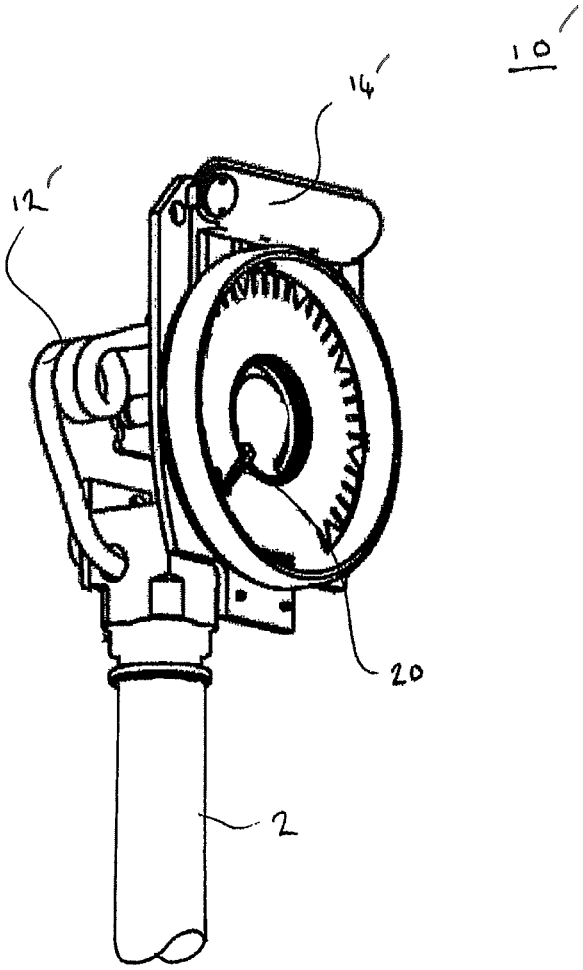
FIG. 2 shows an exemplary embodiment of a pressure detecting device in perspective view.

In the above described embodiment the pressure detecting device 10 comprises a digital pressure gauge. However, FIG. 2 illustrates an exemplary embodiment in which the pressure detecting device 10' comprises a manual pressure gauge. The pressure detecting device 10' comprises a pressure transducer, in the form of a Bourdon tube 12', which converts the detected pressure into mechanical rotational movement of a pointer 20. The amount of movement corresponds to the pressure detected and the pointer 20 indicates on the gauge the pressure detected. A magnet (not shown) is incorporated into the pointer 20 and a Hall effect sensor is provided (not shown) which can detect the angular position of the pointer 20. When the Hall effect sensor detects that the angular position of the pointer 20 has exceeded a threshold that corresponds to the on threshold, then, as for the first embodiment, a wireless transmitter 14' transmits a fixed and finite number of ON pulses (or signals). Similarly, when the Hall effect sensor detects that the angular position of the pointer 20 has fallen below a threshold that corresponds to the off threshold, then, as for the first embodiment, the wireless transmitter 14' transmits a fixed and finite number of OFF pulses (or signals). The use of a manual pressure gauge may reduce the overall cost of the apparatus.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. An apparatus for monitoring a wearer of breathing apparatus, comprising:

a pressure detecting device comprising:

a pressure transducer arranged to detect a pressure of a gas supply of the breathing apparatus;

a wireless transmitter; and a controller configured to cause the wireless transmitter to: (i) wirelessly transmit a preset number of ON signals when the controller determines that the pressure of the gas supply has exceeded a predetermined on threshold, and (ii) wirelessly transmit a preset number of OFF signals if the controller determines that the pressure of the gas supply has fallen below a predetermined off threshold; and a mobile monitoring unit arranged to be attached to the wearer comprising:

a controller;

a motion sensor arranged to monitor the motion of the wearer;

an alarm; and a wireless receiver arranged to receive signals wirelessly transmitted by the wireless transmitter of the pressure detecting device;

wherein the mobile monitoring unit has a plurality of operational states including:

an ON state in which the alarm is activated when the motion sensor has not detected motion for a predetermined period of time; and an OFF state; and wherein the mobile monitoring unit is arranged to be switched from the OFF state to the ON state when the wireless receiver receives at least one ON signal from the wireless transmitter; and wherein the mobile monitoring unit is arranged such that only when the wireless receiver has received at least one OFF signal can it be manually switched from the ON state to the OFF state.

2. An apparatus according to claim 1, wherein the wireless transmitter transmits less than 10 ON signals when it is determined that the pressure of the gas supply has exceeded a predetermined on threshold.

3. An apparatus according to claim 1, wherein the predetermined on threshold is at least 8 bar.

4. An apparatus according to claim 1, wherein the wireless transmitter transmits less than 10 OFF signals when it is determined that the pressure of the gas supply has fallen below a predetermined off threshold.

5. An apparatus according to claim 1, wherein the predetermined off threshold is at least 8 bar.

6. An apparatus according to claim 1, wherein the pressure detecting device is arranged for uni-directional wireless communication with the mobile monitoring unit.

7. An apparatus according to claim 1, wherein the wireless receiver periodically listens for a signal transmitted by a wireless transmitter.

8. An apparatus according to claim 1, wherein the pressure detecting device comprises a manual pressure gauge including the pressure transducer and a pointer rotatably moveable in response to the pressure detected by the pressure transducer so as to display the pressure detected, and a pointer detector for detecting the angular position of the pointer, wherein the wireless transmitter wirelessly transmits a preset number of ON signals when the pointer detector detects that the angular position of the pointer has exceeded a predetermined angular threshold.

9. An apparatus according to claim 8, wherein the wireless transmitter wirelessly transmits a preset number of OFF signals when the pointer detector detects that the angular position of the pointer has fallen below a predetermined angular threshold.

10. An apparatus for monitoring a wearer of breathing apparatus, comprising:

a pressure detecting device comprising:

a pressure transducer arranged to detect a pressure of a gas supply of the breathing apparatus;

a wireless transmitter; and a controller configured to cause the wireless transmitter to: (i) wirelessly transmit a preset number of discrete and spaced apart ON signals when the controller determines that the pressure of the gas supply has exceeded a predetermined on threshold, and (ii) wirelessly transmit a preset number of discrete and spaced apart OFF signals if the controller determines that the pressure of the gas supply has fallen below a predetermined off threshold; and a mobile monitoring unit arranged to be attached to the wearer comprising:

a controller;

a motion sensor arranged to monitor the motion of the wearer;

an alarm; and a wireless receiver arranged to receive signals wirelessly transmitted by the wireless transmitter of the pressure detecting device;

wherein the mobile monitoring unit has a plurality of operational states including:

an ON state in which the alarm is activated when the motion sensor has not detected motion for a predetermined period of time; and an OFF state;

wherein the mobile monitoring unit is arranged to be switched from the OFF state to the ON state when the wireless receiver receives at least one ON signal from the wireless transmitter;

wherein the mobile monitoring unit is arranged such that only when the wireless receiver has received at least one OFF signal can it be manually switched from the ON state to the OFF state; and wherein the wireless receiver periodically listens for a signal transmitted by the wireless transmitter;

wherein the time period between periodic listening times of the wireless receiver and the time period between signals transmitted from the transmitter are configured such that in use the wireless receiver receives at least one signal transmitted from the wireless transmitter; and wherein the pressure detecting device is arranged for uni-directional wireless communication with the mobile monitoring unit.

11. A breathing apparatus comprising the apparatus for monitoring described in claim 1.

12. A breathing apparatus for use by a wearer in hazardous environments, comprising:

a supply of breathable gas;

a pressure detecting device comprising:

a pressure transducer arranged to detect a pressure of the gas supply;

a wireless transmitter; and a controller configured to cause the wireless transmitter to: (i) wirelessly transmit a preset number of ON signals when the controller determines that the pressure of the gas supply has exceeded a predetermined on threshold, and (ii) wirelessly transmit a preset number of OFF signals if the controller determines that the pressure of the gas supply has fallen below a predetermined off threshold; and a mobile monitoring unit comprising:

a controller;

a motion sensor;

an alarm; and a wireless receiver arranged to receive signals wirelessly transmitted by the wireless transmitter of the pressure detecting device;

wherein the mobile monitoring unit has a plurality of operational states including:

an ON state in which the alarm is activated when the motion sensor has not detected motion for a predetermined period of time; and an OFF state;

wherein the mobile monitoring unit is arranged to be switched from the OFF state to the ON state when the wireless receiver receives at least one ON signal from the wireless transmitter; and wherein only when the wireless receiver has received at least one OFF signal can the mobile monitoring unit be manually switched from the ON state to the OFF state.

* * * * *